US007358837B2

(12) United States Patent
Puskar et al.

(10) Patent No.: US 7,358,837 B2
(45) Date of Patent: Apr. 15, 2008

(54) ELECTRICAL SWITCHING APPARATUS AND CIRCUIT BREAKER INCLUDING A MOLDED ENCLOSURE AND MACHINE SCREWS REINFORCING THE SAME

(75) Inventors: Michael P. Puskar, Carnegie, PA (US); William E. Beatty, Jr., Beaver, PA (US); Robert W. Mueller, Aliquippa, PA (US); Arthur D. Carothers, Beaver Falls, PA (US); William M. Randal, Baldwin Township, PA (US)

(73) Assignee: Eaton Corporation, Cleveland, OH (US)

( * ) Notice: Subject to any disclaimer, the term of this patent is extended or adjusted under 35 U.S.C. 154(b) by 28 days.

(21) Appl. No.: 11/402,732

(22) Filed: Apr. 12, 2006

(65) Prior Publication Data

US 2007/0241846 A1 Oct. 18, 2007

(51) Int. Cl.
*H01H 75/00* (2006.01)
*H01H 13/04* (2006.01)

(52) U.S. Cl. ..... 335/6; 335/202; 200/293; 200/303

(58) Field of Classification Search ..... 335/202, 335/6; 200/293–307
See application file for complete search history.

(56) References Cited

U.S. PATENT DOCUMENTS 4,595,896 A 6/1986 DiMarco et al.
5,150,091 A * 9/1992 Hart et al. ..... 335/202
5,910,760 A 6/1999 Malingowski et al.
6,005,207 A 12/1999 DiMarco et al.
6,452,470 B1 9/2002 Malingowski et al.
6,831,536 B1 12/2004 Zindler
6,853,279 B1 2/2005 Puskar et al.
6,970,059 B2 11/2005 Mueller et al.

FOREIGN PATENT DOCUMENTS

EP 1 098 340 A2 5/2001
JP 09 282994 A 10/1997

* cited by examiner

*Primary Examiner*—Ramon M. Barrera
(74) *Attorney, Agent, or Firm*—Martin J. Moran

(57) ABSTRACT

A circuit breaker includes separable contacts, an operating mechanism structured to open and close the separable contacts, a molded enclosure comprising a first molded portion and a second molded portion, a plurality of thread cutting screws fastening the first molded portion to the second molded portion, and a plurality of machine screws. The first molded portion and the second molded portion cooperate to form a plurality of exterior walls. The exterior walls define an interior volume, which encloses the separable contacts and at least a portion of the operating mechanism. The machine screws extend within and reinforce the exterior walls and restrict expansion of the exterior walls away from the interior volume.

8 Claims, 4 Drawing Sheets

ELECTRICAL SWITCHING APPARATUS AND CIRCUIT BREAKER INCLUDING A MOLDED ENCLOSURE AND MACHINE SCREWS REINFORCING THE SAME

BACKGROUND OF THE INVENTION

1. Field of the Invention

The invention relates to electrical switching apparatus, such as, for example, circuit breakers and, more particularly, to molded case circuit breakers.

2. Background Information

Circuit breakers, such as molded case circuit breakers, include at least one pair of separable contacts. A first contact is fixed within the molded case and a second movable contact is coupled to an operating mechanism. These separable contacts are in electrical communication with either the line or the load coupled to the circuit breaker. The operating mechanism moves the movable contact between a first, open position wherein the movable contact is spaced from the fixed contact, and a second, closed position wherein the fixed and movable contacts are in contact and electrical communication. The operating mechanism may be operated manually or by a trip mechanism.

Circuit breaker molded cases are typically constructed of a glass polyester or other molded material. Generally, these molded cases are a two-piece molding.

When interruption of relatively high electrical currents occurs, hot gases are formed that can exert significant pressure on the molded case. The outer walls of the molded case may be subjected to relatively high pressure and, thus, severe stress, resulting from the extreme expansion of gasses. Because the gas pressure is relatively high and the molded case walls are relatively thin, the molded case is susceptible to breaking due to the pressure and the resulting stresses. The exterior walls of molded case circuit breakers have, thus, typically been a weak link for case strength and a limiting factor in increasing the interrupting ratings of circuit breakers.

Typically, the molded cover and molded base of molded case circuit breakers are joined by conventional thread cutting screws, which cut threads into the molded material. However, that molded material may crack apart and the conventional thread cutting screws may be pulled out of the molded case during the process of interruption.

One prior proposal mounts the internal components of the circuit breaker poles on or in metal, which then attaches to the molded case.

U.S. Pat. No. 4,595,896 discloses a circuit breaker in which each pole of the circuit breaker has a reinforced molded housing. The walls of the housing are provided with reinforcing molded ribs to withstand the high pressures caused by gases generated by the arc during interruption.

U.S. Pat. No. 6,452,470 discloses that outward gas forces have a tendency to put downward pressure on portions of side walls that connect with the bottom of the molded base. Support members provide underneath support for the side walls, thereby substantially preventing bottom corner areas of the molded case from being unduly stressed and bent by the aforementioned forces.

U.S. Pat. No. 6,970,059 discloses a circuit breaker in which the rigid legs of a slot motor reinforce the exterior walls of the molded housing.

It is known in some relatively large molded case circuit breakers to use only machine screws and hex nuts for the purpose of holding the molded cover in place on the molded base. The same types of machine screws and hex nuts are employed in both the molded case external walls and the molded case internal walls.

It is also known in other relatively large molded case circuit breakers to use machine screws and hex nuts within relatively thick internal walls for the purpose of holding the molded cover in place on the molded base, and to use thread cutting screws within relatively thinner external walls for the same purpose of holding the molded cover in place on the molded base.

There is room for improvement in electrical switching apparatus employing molded enclosures.

There is also room for improvement in molded case circuit breakers.

SUMMARY OF THE INVENTION

These needs and others are met by embodiments of the invention which provide an electrical switching apparatus including a molded enclosure in which a plurality of thread cutting screws fasten a first molded portion to a second molded portion. The first and second molded portions cooperate to form a plurality of exterior walls, which define an interior volume enclosing separable contacts and at least a portion of an operating mechanism. A number of machine screws extend within and reinforce a number of the exterior walls and restrict expansion of the exterior walls away from the interior volume.

In accordance with one aspect of the invention, an electrical switching apparatus comprises: separable contacts; an operating mechanism structured to open and close the separable contacts; a molded enclosure comprising a first molded portion and a second molded portion; a plurality of thread cutting screws fastening the first molded portion to the second molded portion; and a number of machine screws, wherein the first molded portion and the second molded portion cooperate to form a plurality of exterior walls, wherein the exterior walls define an interior volume, wherein the interior volume encloses the separable contacts and at least a portion of the operating mechanism, and wherein the machine screws extend within and reinforce a number of the exterior walls and restrict expansion of the exterior walls away from the interior volume.

The exterior walls may include a first wall portion having a first thickness, a second wall portion having a second thickness and a third wall portion having a third thickness, the third thickness being greater than the first and second thicknesses. One of the machine screws may be intermediate the first wall portion and the second wall portion of one of the exterior walls. The first and second wall portions may include an interior side facing the interior volume, an opposite exterior side and a solid thickness therebetween of about 0.125 inch.

As another aspect of the invention, a circuit breaker comprises: separable contacts; an operating mechanism structured to open and close the separable contacts; a molded enclosure comprising a first molded portion and a second molded portion, the first and second molded portions cooperating to define an interior volume, a first side, an opposite second side, a pair of exterior side walls and a pair of end walls, the exterior side walls and the end walls extending between the first side and the opposite second side, the first and second molded portions enclosing the separable contacts and at least a portion of the operating mechanism, the first side and the opposite second side including a number of openings, at least some of the exterior side walls including a number of apertures extending from a corresponding one of the openings of the first side to a corresponding one of the openings of the opposite second side; a plurality of thread cutting screws fastening the first molded portion to the second molded portion; and a plurality of machine screws extending within the apertures, the machine screws holding the first molded portion to the second molded portion and restricting expansion of the exterior side walls away from the interior volume.

One of the machine screws may be disposed through a corresponding one of the openings of the first side, and through a corresponding one of the apertures to a corresponding one of the openings of the opposite second side. The nut may be disposed in the corresponding one of the openings of the opposite second side and may engage the one of the machine screws therein.

The exterior side walls may be longer than the end walls. The nut may have a rectangular shape, a width parallel to the end walls and a length parallel to the exterior side walls, the length being longer than the width. The corresponding one of the openings of the opposite second side may have the rectangular shape.

The operating mechanism may further comprise a crossbar and a trip unit. The exterior side walls may include a first wall portion proximate the crossbar and a second wall portion proximate the trip unit. A first one of the machine screws may be intermediate the first wall portion and the second wall portion of a first one of the exterior side walls, and a second one of the machine screws may be intermediate the first wall portion and the second wall portion of a second one of the exterior side walls. The first and second wall portions may include an interior side facing the interior volume, an exterior side and a solid thickness therebetween in the range of 0.250 inch to about 0.125 inch.

As another aspect of the invention, a circuit breaker comprises: an arc chamber; separable contacts proximate the arc chamber; an operating mechanism structured to open and close the separable contacts; a trip unit cooperating with the operating mechanism to trip open the separable contacts; a molded enclosure comprising a first molded portion and a second molded portion; a plurality of thread cutting screws fastening the first molded portion to the second molded portion; and a plurality of machine screws, wherein the first molded portion and the second molded portion cooperate to form a plurality of exterior side walls, wherein the exterior side walls define an interior volume, wherein the interior volume encloses the separable contacts, the arc chamber and at least a portion of the operating mechanism, wherein the exterior side walls include a first wall portion proximate the operating mechanism and a second wall portion proximate the trip unit, wherein a first one of the machine screws is intermediate the first wall portion and the second wall portion of a first one of the exterior side walls, wherein a second one of the machine screws is intermediate the first wall portion and the second wall portion of a second one of the exterior side walls, and wherein the first and second ones of the machine screws hold the first molded portion to the second molded portion and restrict expansion of the first and second ones of the exterior side walls away from the interior volume.

Each of the first and second wall portions may include an interior side facing the interior volume, an exterior side and a solid thickness therebetween of about 0.125 inch. The interior side may include a portion facing the arc chamber. Each of the exterior side walls may include a thickness of at least about 0.148 inch from a corresponding one of the machine screws to the portion facing the arc chamber.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "fastener" refers to any suitable connecting or tightening mechanism expressly including, but not limited to, rivets, bolts and screws.

As employed herein, the term "screw" refers to a fastener including a shaft with a helical groove or thread formed on its surface. A screw may be used, for example, as a threaded fastener to hold objects together and/or as a simple machine to translate torque into linear force. A screw may also be defined as an inclined plane wrapped around a shaft.

As employed herein, the term "machine screw" means a screw or a suitably sized bolt having a cylindrical shaft. A machine screw fits into an aperture, a nut and/or a tapped hole and is preferably threaded at least substantially its entire length. A "machine screw" does not mean and, thus, expressly excludes a "thread cutting screw".

As employed herein, the term "thread cutting screw" means a self-tapping screw which advances when turned while creating its own thread in a plastic or molded component, such as, for example, a molded case enclosure, a molded cover or a molded base. Thread cutting screws preferably have sharp threads that cut into the plastic or molded component. Thread cutting screws may be notched at the tip to aid in chip removal during thread cutting. A thread cutting screw does not normally fit into a nut or a pre-tapped hole, but may be removed from and/or be re-advanced into its own self-tapped hole or may be advanced into a similarly tapped hole cut by the same or substantially similar thread cutting screw. A "thread cutting screw" does not mean and, thus, expressly excludes a "machine screw".

As employed herein, the term "nut" means a type of hardware, such as, for example, a piece of metal having a hole with internal screw thread to be fitted onto a machine screw which is inserted through apertures of two or more objects, in order to couple these objects to each other. A nut often has a square or hexagonal shape, but may also have any suitable shape, such as a rectangular shape (i.e., cross-section).

The invention is described in association with a three-pole circuit breaker, although the invention is applicable to a wide range of electrical switching apparatus having any number of poles.

Figure 1:
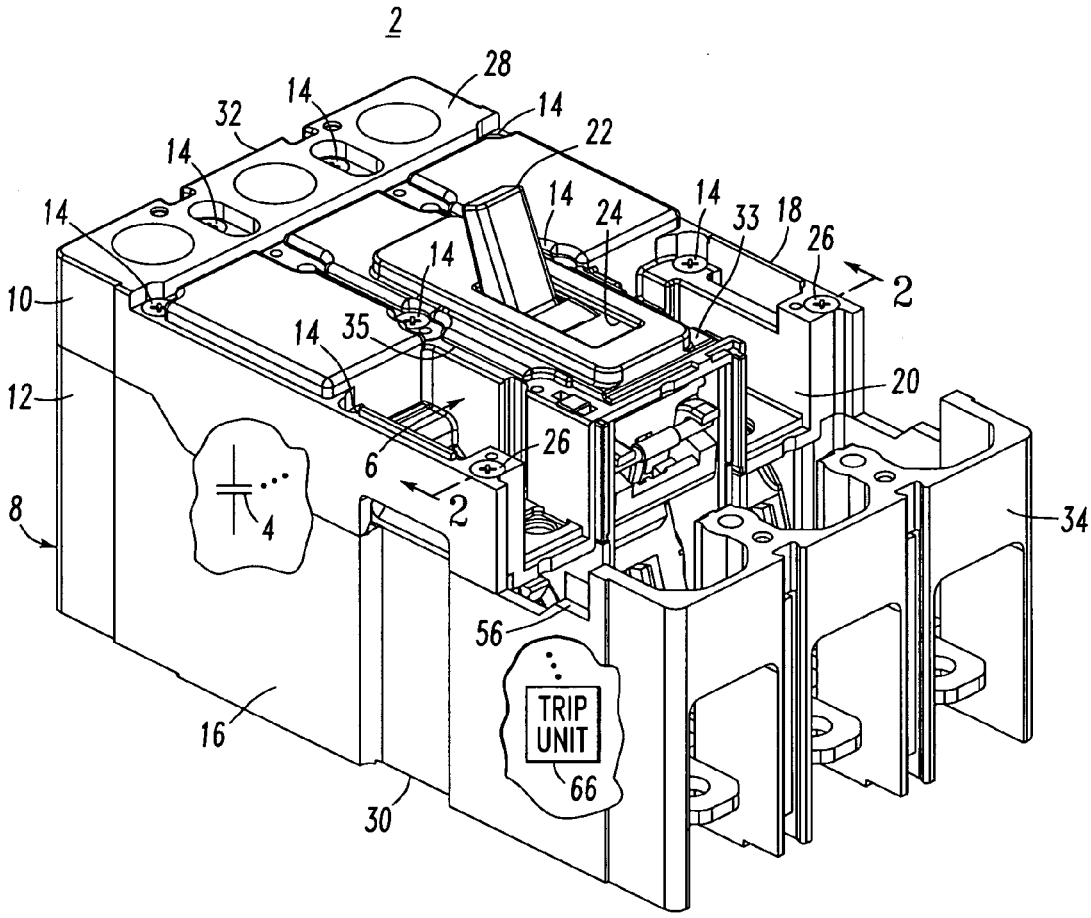
FIG. 1 is an isometric view of a molded case circuit breaker in which some components are shown in simplified form and in which a portion of the molded cover is removed for clarity of illustration in accordance with an embodiment of the invention.

Referring to FIG. 1, an electrical switching apparatus, such as circuit breaker 2, includes separable contacts 4, an operating mechanism 6 structured to open and close the separable contacts 4, and a molded enclosure (e.g., molded case) 8 including a first molded portion, such as molded cover 10, and a second molded portion, such as molded base 12. A plurality of conventional thread cutting screws 14 fasten the molded cover 10 to the molded base 12. The molded cover and base 10,12 cooperate to form a plurality of exterior walls, such as 16,18, which define an interior volume 20. The interior volume 20 encloses the separable contacts 4 and at least a portion of the operating mechanism 6, which includes an operating handle 22 extending through an opening 24 in the molded cover 10. A number (e.g., two are shown in FIG. 1) of machine screws 26 extend within and reinforce a number (e.g., two walls are shown in FIG. 1) of the exterior walls 16,18 and restrict expansion (e.g., bulging) of such exterior walls away from the interior volume 20 in response to an interruption event.

The molded cover and base 10,12 include a first side 28, an opposite second side 30, the pair of exterior side walls 16,18 and a pair of end walls 32,34. The exterior side walls 16,18 and the end walls 32,34 extend between the first side 28 and the opposite second side 30.

A non-limiting example of the thread cutting screws 14 is a #6-32 thread cutting screw, although any suitable thread cutting screw may be employed. As shown in FIG. 1, the example thread cutting screws 14 are disposed in interior walls, such as 33,35, the end wall 32 and the exterior side walls 16,18, although any suitable count of thread cutting screws in any suitable wall dispositions may be employed.

Figure 2:
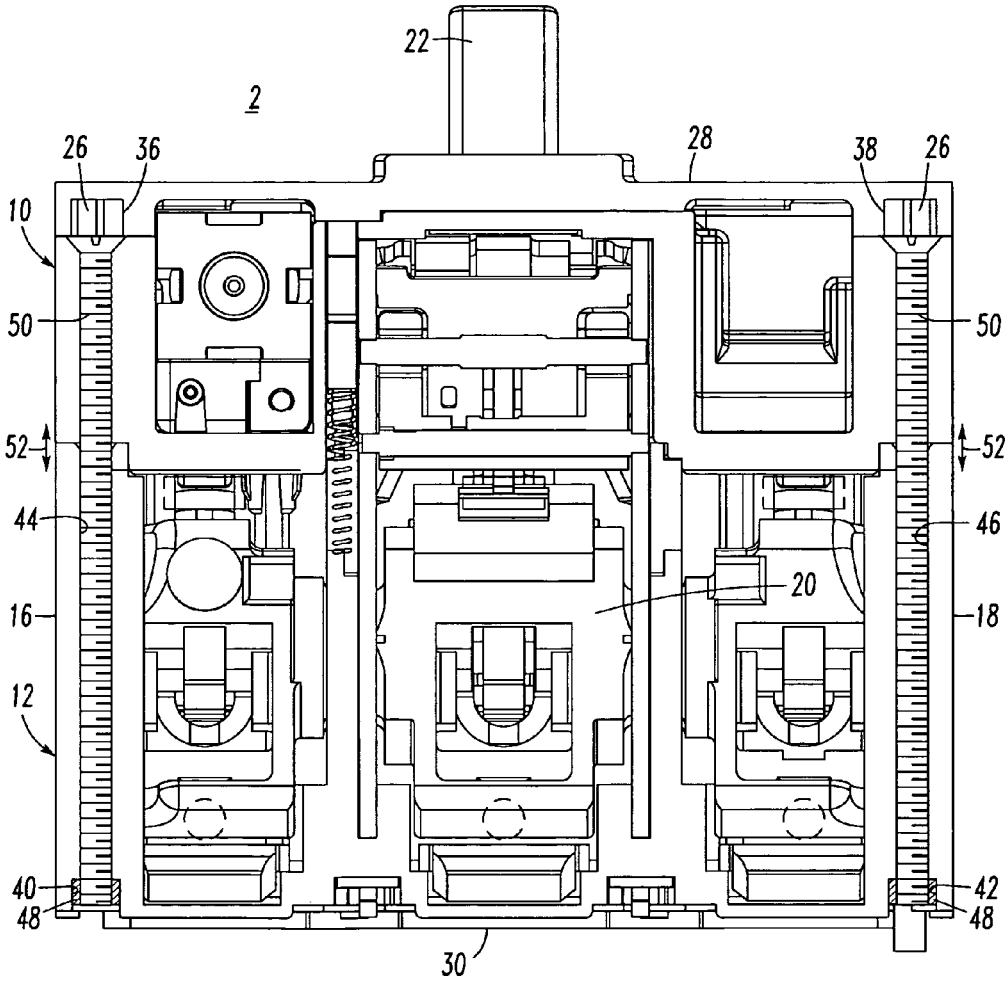
FIG. 2 is a cross-sectional view along lines 2-2 of FIG. 1.
Figure 4:
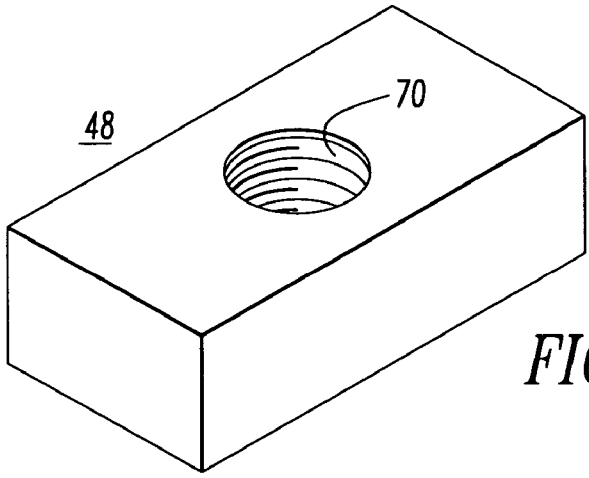
FIG. 4 is an isometric view of the nut of FIG. 2.
Figure 5:
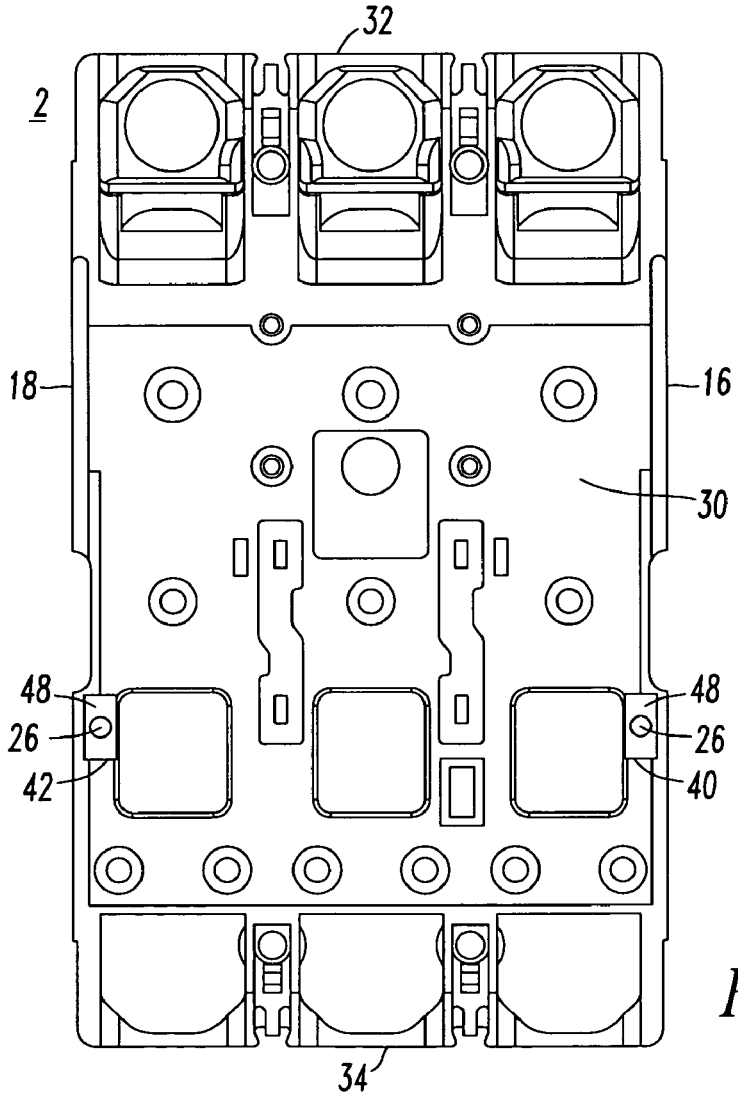
FIG. 5 is a bottom plan view of the molded base of FIG. 1 including two nuts of FIG. 4.

Also referring to FIG. 2, the first side 28 and the opposite second side 30 include a number of openings, such as 36,38 and 40,42, respectively. The exterior side walls 16,18 include respective apertures 44,46 extending from a corresponding one of the openings 36,38 of the first side 28 to a corresponding one of the openings 40,42 of the opposite second side 30. The two example machine screws 26 extend from the top (with respect to FIGS. 1 and 2) of the molded cover 10 to the bottom (with respect to FIGS. 1 and 2) of the molded base 12. The machine screws 26 extend within the apertures 44,46, hold the molded cover 10 to the molded base 12, and restrict expansion of the exterior side walls 16,18 away from the interior volume 20. The machine screws 26 are secured in place by nuts 48 (as best shown in FIGS. 4 and 5) disposed in the openings 40,42 in the bottom (with respect to FIGS. 1 and 2) of the molded base 12. The nuts 48 threadably engage the threads 50 of the machine screws 26, which add strength to keep the exterior side walls 16,18 from bulging outward during interruption. The machine screws 26 define a longitudinal axis 52 extending from the molded cover 10 to the molded base 12 and cooperate with the nuts 48 to hold the molded cover and base tightly together.

Figure 3:
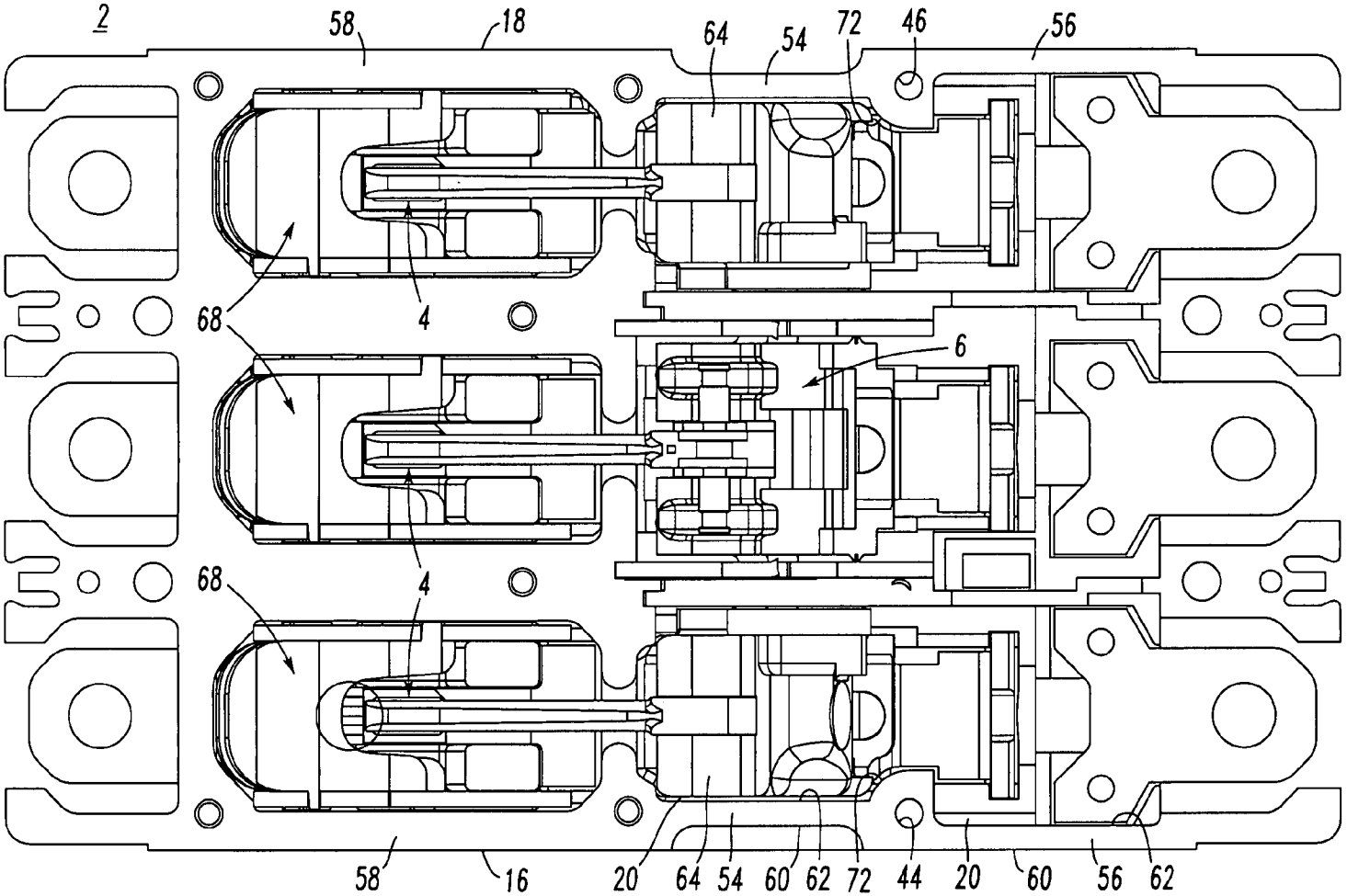
FIG. 3 is cross-sectional view of the molded base of FIG. 1 taken at the point where the reinforced base walls around the machine screws are the thickest.

Referring to FIG. 3, the exterior side walls 16,18 include a first wall portion 54 having a first thickness, a second wall portion 56 having a second thickness and a third wall portion 58 having a third thickness, with the third thickness being greater than the first and second thicknesses. The machine screws 26 (shown in FIGS. 1 and 2) are within the apertures 44,46 intermediate the first wall portion 54 and the second wall portion 56 of the exterior side walls 16,18. The exterior side walls 16,18 are generally planar and include (as shown with exterior side wall 16) an exterior side 60 and an opposite interior side 62 facing the interior volume 20. The machine screws 26 (FIGS. 1 and 2) extend through the exterior side walls 16,18 generally intermediate (as shown with exterior side wall 16 and aperture 44) the exterior side 60 and the opposite interior side 62.

The operating mechanism 6 includes a crossbar 64 and a trip unit 66 (shown in FIG. 1) cooperating with the operating mechanism to trip open the separable contacts 4 (FIGS. 1 and 3). The first wall portion 54 is proximate the operating mechanism 6 and crossbar 64, and the second wall portion 56 is proximate the trip unit 66. In this example, the separable contacts 4 of each pole are proximate a corresponding arc chamber 68. The interior volume 20 encloses the separable contacts 4, the arc chambers 68 and at least a portion of the operating mechanism 6.

EXAMPLE 1

Referring to FIGS. 4 and 5, the length of the exterior side walls 16,18 is longer than the width of the end walls 32,34. The nuts 48 have a rectangular shape, a width parallel to the end walls 32,34 and a length parallel to the exterior side walls 16,18. As a non-limiting example, the length of the nut is about 0.400 inch, the width of the nut is about 0.200 inch and the thickness of the nut is about 0.125 inch. The nuts 48 have a pre-tapped hole 70, which threadably engages (as best shown in FIG. 2) the threads 50 of the corresponding machine screw 26. The corresponding openings 40,42 (FIG. 2) of the bottom (with respect to FIGS. 1 and 2) side 30 have the same rectangular shape as the rectangular shape of the nuts 48.

EXAMPLE 2

In this example, the machine screws 26 are #6-32×3.094 inch machine screws made of zinc chromate plated steel. The nuts 48 (FIG. 4) are also made of zinc chromate plated steel. The machine screws 26 are superior to conventional thread cutting screws (e.g., #6-32), such as 14 of FIG. 1, which may be pulled out of the molded enclosure 8 during the process of interruption. Also, the molded material that the conventional thread cutting screws 14 cut threads into may crack apart. In contrast, the machine screws 26 can achieve a higher tightening torque and, thus, effectively "sandwich" the molded cover 10 and molded base 12 together.

EXAMPLE 3

The total thickness of the molded material from the machine screw holes 44,46 (FIGS. 2 and 3) to the interior wall 72 (FIG. 3) that faces the arc chambers 68 is at least about 0.148 inch. Preferably, this thickness at least faces the arc chambers 68, as shown. Most preferably, the thickness is employed all the way around (not shown) the screw holes, if possible. This molded material around the machine screw holes 44,46 adds strength to keep the molded material from cracking away from the machine screw 26 during an interruption event.

EXAMPLE 4

The first and second wall portions 54,56 of FIG. 3 include the interior side 62 facing the interior volume 20, an exterior side 60 and a solid thickness therebetween of about 0.125 inch.

EXAMPLE 5

The first and second wall portions 54,56 of FIG. 3 include the interior side 62 facing the interior volume 20, an exterior side 60 and a solid thickness therebetween in the range of 0.250 inch to about 0.125 inch.

The benefits of the circuit breaker 2 employing the machine screws 26 include holding the molded base 12 and the molded cover 10 tightly together, and providing strength to keep the exterior side walls 16,18 of the molded enclosure 8 from bulging or otherwise expanding outward during an interruption event.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker comprising:

an arc chamber;

separable contacts proximate said arc chamber;

an operating mechanism structured to open and close said separable contacts;

a trip unit cooperating with said operating mechanism to trip open said separable contacts;

a molded enclosure comprising a first molded portion and a second molded portion;

a plurality of thread cutting screws fastening said first molded portion to said second molded portion; and a plurality of machine screws, wherein said first molded portion and said second molded portion cooperate to form a plurality of exterior side walls, wherein said exterior side walls define an interior volume, wherein said interior volume encloses said separable contacts, said arc chamber and at least a portion of said operating mechanism, wherein said exterior side walls include a first wall portion proximate said operating mechanism and a second wall portion proximate said trip unit, wherein a first one of said machine screws is intermediate the first wall portion and the second wall portion of a first one of said exterior side walls, wherein a second one of said machine screws is intermediate the first wall portion and the second wall portion of a second one of said exterior side walls, and wherein said first and second ones of said machine screws hold said first molded portion to said second molded portion and restrict expansion of said first and second ones of said exterior side walls away from said interior volume.

2. The circuit breaker of claim 1 wherein each of said first and second wall portions includes an interior side facing said interior volume, an exterior side and a solid thickness therebetween of about 0.125 inch.

3. The circuit breaker of claim 2 wherein said interior side includes a portion facing said arc chamber; and wherein each of said exterior side walls includes a thickness of at least about 0.148 inch from a corresponding one of said machine screws to said portion facing said arc chamber.

4. A circuit breaker comprising:

separable contacts;

an operating mechanism structured to open and close said separable contacts;

a molded enclosure comprising a first molded portion and a second molded portion, said first and second molded portions cooperating to define an interior volume, a first side, an opposite second side, a pair of exterior side walls and a pair of end walls, said exterior side walls and said end walls extending between the first side and the opposite second side, said first and second molded portions enclosing said separable contacts and at least a portion of said operating mechanism, the first side and the opposite second side including a number of openings, at least some of said exterior side walls including a number of apertures extending from a corresponding one of the openings of the first side to a corresponding one of the openings of the opposite second side;

a plurality of thread cutting screws fastening said first molded portion to said second molded portion;

a plurality of machine screws extending within said apertures, said machine screws holding said first molded portion to said second molded portion and restricting expansion of said exterior side walls away from said interior volume; and wherein one of said machine screws is disposed through a corresponding one of the openings of the first side, through a corresponding one of said apertures to a corresponding one of the openings of the opposite second side; and wherein a nut is disposed in the corresponding one of the openings of the opposite second side and engages said one of said machine screws therein.

5. The circuit breaker of claim 4 wherein said exterior side walls are longer than said end walls; wherein said nut has a rectangular shape, a width parallel to said end walls and a length parallel to said exterior side walls, said length being longer than said width; and wherein the corresponding one of the openings of the opposite second side has said rectangular shape.

6. A circuit breaker comprising:

separable contacts;

an operating mechanism structured to open and close said separable contacts;

a molded enclosure comprising a first molded portion and a second molded portion, said first and second molded portions cooperating to define an interior volume, a first side, an opposite second side, a pair of exterior side walls and a pair of end walls, said exterior side walls and said end walls extending between the first side and the opposite second side, said first and second molded portions enclosing said separable contacts and at least a portion of said operating mechanism, the first side and the opposite second side including a number of openings, at least some of said exterior side walls including a number of apertures extending from a corresponding one of the openings of the first side to a corresponding one of the openings of the opposite second side;

a plurality of thread cutting screws fastening said first molded portion to said second molded portion;

a plurality of machine screws extending within said apertures, said machine screws holding said first molded portion to said second molded portion and restricting expansion of said exterior side walls away from said interior volume; and wherein said molded enclosure further comprises a plurality of interior walls; and wherein said thread cutting screws are #6-32 thread cutting screws disposed in some of said interior walls, some of said end walls and some of said exterior side walls.

7. A circuit breaker comprising:

separable contacts;

an operating mechanism structured to open and close said separable contacts;

a molded enclosure comprising a first molded portion and a second molded portion, said first and second molded portions cooperating to define an interior volume, a first side, an opposite second side, a pair of exterior side walls and a pair of end walls, said exterior side walls and said end walls extending between the first side and the opposite second side, said first and second molded portions enclosing said separable contacts and at least a portion of said operating mechanism, the first side and the opposite second side including a number of openings, at least some of said exterior side walls including a number of apertures extending from a corresponding one of the openings of the first side to a corresponding one of the openings of the opposite second side;

a plurality of thread cutting screws fastening said first molded portion to said second molded portion;

a plurality of machine screws extending within said apertures, said machine screws holding said first molded portion to said second molded portion and restricting expansion of said exterior side walls away from said interior volume; and wherein said operating mechanism further comprises a crossbar and a trip unit; wherein said exterior side walls include a first wall portion proximate said crossbar and a second wall portion proximate said trip unit; wherein a first one of said machine screws is intermediate the first wall portion and the second wall portion of a first one of said exterior side walls; and wherein a second one of said machine screws is intermediate the first wall portion and the second wall portion of a second one of said exterior side walls.

8. The circuit breaker of claim 7 wherein said first and second wall portions include an interior side facing said interior volume, an exterior side and a solid thickness therebetween in the range of 0.250 inch to about 0.125 inch.

* * * * *